US008718523B2

(12) United States Patent
Miyoshi

(10) Patent No.: US 8,718,523 B2
(45) Date of Patent: May 6, 2014

(54) HEATING AND PRESSURIZING DEVICE AND IMAGE FORMING APPARATUS FOR CONTROLLING A CONTACT PRESSURE BETWEEN A PAIR OF HEATING AND PRESSURIZING MEMBERS

(75) Inventor: Noriyuki Miyoshi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 13/092,647

(22) Filed: Apr. 22, 2011

(65) Prior Publication Data

US 2012/0114352 A1 May 10, 2012

(30) Foreign Application Priority Data

Nov. 9, 2010 (JP) ..... 2010-251324

(51) Int. Cl.
*G03G 15/20* (2006.01)

(52) U.S. Cl.
USPC ..... 399/328; 399/45

(58) Field of Classification Search
USPC ..... 399/67, 45, 328
See application file for complete search history.

(56) References Cited

U.S. PATENT DOCUMENTS 5,140,378 A * 8/1992 Ibuchi et al. ..... 355/406
2005/0254845 A1* 11/2005 Taki et al. ..... 399/45
2007/0212085 A1* 9/2007 Mitsuya et al. ..... 399/45
2007/0223977 A1* 9/2007 Matsubara et al. ..... 399/329
2009/0324307 A1* 12/2009 Tsukamoto et al. ..... 399/328
2010/0158553 A1* 6/2010 Ueno ..... 399/67
2011/0176821 A1* 7/2011 Hase ..... 399/45
2011/0222879 A1* 9/2011 Okamoto ..... 399/44
2011/0280636 A1* 11/2011 Nakamura et al. ..... 399/327
2012/0070206 A1* 3/2012 Tsukioka ..... 399/328
2013/0011160 A1* 1/2013 Kanai et al. ..... 399/122

FOREIGN PATENT DOCUMENTS

JP 2-282773 A 11/1990
JP 9-269695 A 10/1997
JP 3802123 B2 7/2006
JP 2010-78903 A 4/2010

* cited by examiner

*Primary Examiner* — G. M. Hyder
(74) *Attorney, Agent, or Firm* — Sughrue Mion, PLLC

(57) ABSTRACT

A heating and pressurizing device includes a heating and pressurizing unit that includes a pair of members in contact with each other, at least one of the pair of members being to be heated, and that heats and pressurizes a medium between the pair of members, a change unit that changes a contact pressure between the pair of members by changing a relative position of the pair of members according to a control signal, and a controller that sends the control signal to the change unit and includes a detecting unit that detects a difference between a target distance and an actual distance. The target distance corresponds to a predetermined distance, and the actual distance corresponds to a distance of which the pair of members are positioned after the controller sends a predetermined control signal set as corresponding to the predetermined distance as the control signal to the change unit.

5 Claims, 11 Drawing Sheets

| Paper type information | | Target angle(°) | Reference elapsed time Tb1(msec) |
|---|---|---|---|
| Type | Basis weight(gsm) | | |
| Uncoated paper | < 80 | 0.0 | 0 |
| | 80 ≤, < 150 | 25.5 | 150 |
| | 150 ≤, < 200 | 42.6 | 250 |
| | 200 ≤, < 300 | 59.6 | 350 |
| Coated paper | < 80 | 0.0 | 0 |
| | 80 ≤, < 150 | 28.9 | 170 |
| | 150 ≤, < 200 | 46.0 | 270 |
| | 200 ≤, < 300 | 63.0 | 370 |

| Paper type information | | Reference remaining time Tb2(msec) |
|---|---|---|
| Type | Basis weight(gsm) | |
| Uncoated paper | < 80 | 705 |
| | 80 ≤, < 150 | 555 |
| | 150 ≤, < 200 | 455 |
| | 200 ≤, < 300 | 355 |
| Coated paper | < 80 | 705 |
| | 80 ≤, < 150 | 535 |
| | 150 ≤, < 200 | 435 |
| | 200 ≤, < 300 | 335 |

PRESS-CONTACT RELEASE STATE

SENSOR DETECTS

MOTOR STOPPED

MEASUREMENT OF REMAINING TIME

SENSOR DETECTS

PRESS-CONTACT RELEASE DELAY TIME ELAPSED

HEATING AND PRESSURIZING DEVICE AND IMAGE FORMING APPARATUS FOR CONTROLLING A CONTACT PRESSURE BETWEEN A PAIR OF HEATING AND PRESSURIZING MEMBERS

CROSS-REFERENCE TO RELATED APPLICATIONS

This application is based on and claims priority under 35 USC 119 from Japanese Patent Application No. 2010-251324 filed Nov. 9, 2010.

BACKGROUND (i) Technical Field

The present invention relates to a heating and pressurizing device and an image forming apparatus.

(ii) Related Art

In recent devices for heating and pressurizing a medium, a pair of heating and pressurizing members, that is, a heating member for heating the medium and a pressurizing member for pressurizing the heating member, are provided. A contact pressure between the pair of heating and pressurizing members is increased to heat and pressurize the medium, and is decreased when the medium is not heated and pressurized.

During heating and pressurization of a thick medium, such as a thick paper, pressure concentrates at both ends of the thick paper in a direction intersecting a paper transport direction, as compared with heating and pressurization of a thinner paper. In such a case, it is preferable that the contact pressure, which is provided between a pair of heating and pressurizing members to heat and pressurize the thick paper, should be lower than when the thinner paper is heated and pressurized. It is preferable to properly change the contact pressure to a target contact pressure according to the type of medium.

SUMMARY

According to an aspect of the invention, there is provided a heating and pressurizing device including a heating and pressurizing unit that includes a pair of members in contact with each other, at least one of the pair of members being to be heated, and that heats and pressurizes a medium between the pair of members; a change unit that changes a contact pressure between the pair of members in the heating and pressurizing unit by changing a relative position of the pair of members according to a control signal; and a controller that sends the control signal to the change unit, the controller including a detecting unit that detects a difference between a target distance and an actual distance, the target distance corresponding to a predetermined distance, and the actual distance corresponding to a distance of which the pair of members are positioned after the controller sends a predetermined control signal which is set as corresponding to the predetermined distance as the control signal to the change unit.

BRIEF DESCRIPTION OF THE DRAWINGS

An exemplary embodiment of the present invention will be described in detail based on the following figures, wherein.

DETAILED DESCRIPTION

An exemplary embodiment will be described in detail below with reference to the attached drawings.

Figure 1:
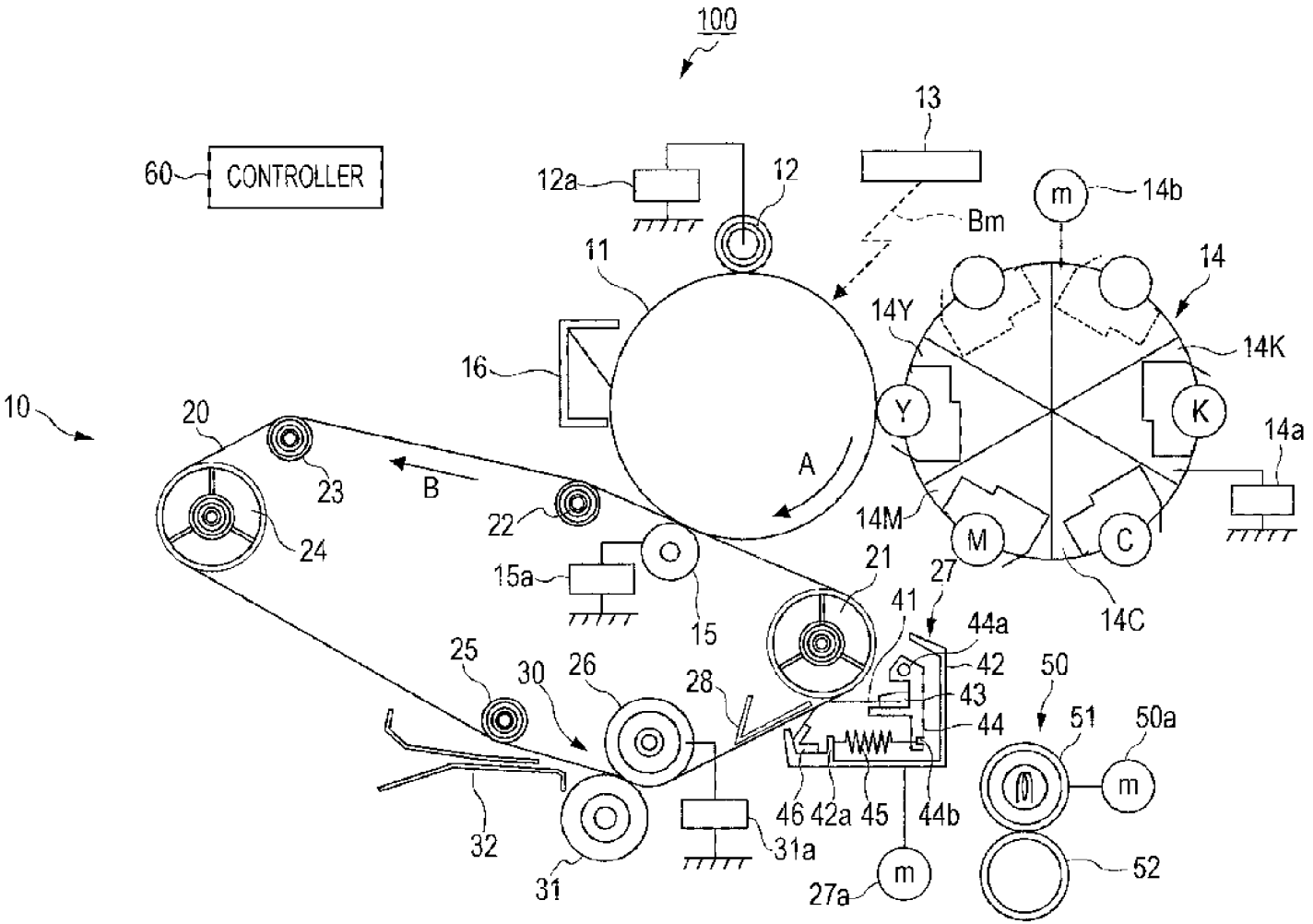
FIG. 1 illustrates a schematic configuration of a color image forming apparatus according to an exemplary embodiment.

FIG. 1 illustrates a schematic configuration of a color image forming apparatus 100 according to an exemplary embodiment.

The color image forming apparatus 100 of the exemplary embodiment includes an image forming section 10 serving as an example of an image forming section that forms an image on paper as an example of a medium, and a controller 60 serving as an example of a controller that controls the image forming section 10.

The image forming section 10 includes a photoconductor drum 11 serving as an image carrier provided rotatably in the direction of arrow A, and an intermediate transfer belt 20 provided rotatably in the direction of arrow B and serving as a transfer member on which color component toner images formed on the photoconductor drum 11 are sequentially transferred and held (primary transfer). The color image forming apparatus 100 also includes a secondary transfer unit 30 that transfers superimposed toner images transferred on the intermediate transfer belt 20 together onto the paper (secondary transfer), a fixing device 50 that fixes the secondarily transferred images on the paper, and a controller 60 serving as an example of a controller that controls the mechanisms in the color image forming apparatus 100.

The image forming section 10 further includes, around the photoconductor drum 11, a charging roller 12 that charges the photoconductor drum 11, a laser exposure device 13 that writes an electrostatic latent image on the photoconductor drum 11 (an exposure beam is denoted by Bm in FIG. 1), and a rotary developing device 14 that develops the electrostatic latent image on the photoconductor drum 11 with toner to form a visible image. In the rotary developing device 14, developing units 14Y, 14M, 14C, and 14K that store color component toners of yellow (Y), magenta (M), cyan (C), and black, (K) are provided rotatably. The image forming section 10 further includes, around the photoconductor drum 11, a primary transfer roller 15 that transfers color component toner images formed on the photoconductor drum 11 onto the intermediate transfer belt 20, and a drum cleaner 16 that removes residual toner from the photoconductor drum 11. These electrophotographic devices, such as the charging roller 12, the laser exposure device 13, the rotary developing device 14, the primary transfer roller 15, and the drum cleaner 16, are arranged in order around the photoconductor drum 11.

The photoconductor drum 11 includes a metallic thin cylindrical drum and an organic photosensitive layer provided on a surface of the cylindrical drum. The organic photosensitive layer is formed of a material that is to be negatively charged. Since the developing units 14Y, 14M, 14C, and 14K perform reversal development, the toner used in the developing units 14Y, 14M, 14C, and 14K is to be negatively charged.

The charging roller 12 includes a metallic shaft, an epichlorohydrin rubber layer provided on a surface of the metallic shaft, and a polyamide layer having a thickness of about 3 μm and provided on a surface of the epichlorohydrin rubber layer. The polyamide layer contains conductive tin oxide powder.

A charging-bias power supply 12*a* for applying a predetermined charging bias is connected to the charging roller 12, a developing-bias power supply 14*a* for applying a predetermined developing bias to the developing units 14Y, 14M, 14C, and 14K is connected to the rotary developing device 14, and a primary-transfer-bias power supply 15*a* for applying a predetermined primary transfer bias is connected to the primary transfer roller 15. Further, the rotary developing device 14 is provided with a developing-device driving motor 14*b* for rotating the rotary developing device 14 so that the developing units 14Y, 14M, 14C, and 14K face the photoconductor drum 11. Meanwhile, the photoconductor drum 11 is grounded.

The intermediate transfer belt 20 is stretched around plural (six in the exemplary embodiment) rollers 21 to 26. Among these rollers, the rollers 21 and 25 are driven rollers, the roller 22 is a metallic idle roller used to position the intermediate transfer belt 20 and to form a flat primary transfer surface, the roller 23 is a tension roller used to maintain a constant tension of the intermediate transfer belt 20, and the roller 26 is a backup roller for secondary transfer that will be described below. The intermediate transfer belt 20 is formed of resin, such as polyimide, polycarbonate, polyester, polypropylene, polyethylene terephthalate, acrylic, or vinyl chloride, or rubber, which contains an appropriate amount of carbon black as a conductive material. The intermediate transfer belt 20 has a surface resistivity of $10^{11}$ Ω/sq., a volume resistivity of $10^{11}$ Ω·cm, and a thickness of 150 μm.

The secondary transfer unit 30 includes a secondary transfer roller 31 provided on a toner-image carrying side of the intermediate transfer belt 20, and the backup roller 26. The backup roller 26 includes a tube formed of a rubber blend of EPDM and NBR on which carbon is dispersed, and EPDM rubber provided in the tube. The backup roller 26 has a surface resistivity of 7 to 10 log Ω/sq. and a hardness of, for example, 70° (ASKER C). A secondary-transfer-bias power supply 31*a* for applying a predetermined secondary transfer bias is connected to the backup roller 26. In contrast, the secondary transfer roller 31 is grounded. On the upstream side of the secondary transfer unit 30, a paper transport guide 32 is provided to guide transported paper to the secondary transfer unit 30.

The image forming section 10 further includes, on the downstream side of the secondary transfer unit 30, a belt cleaner 27 serving as a cleaner that removes residual toner attached on the intermediate transfer belt 20 after secondary transfer. The image forming section 10 further includes a plate member 28 provided at a position opposing the belt cleaner 27 with the intermediate transfer belt 20 being disposed therebetween. The plate member 28 extends along an inner surface of the intermediate transfer belt 20.

The belt cleaner 27 includes a scraper 41 formed by a stainless steel plate or the like and provided on the image carrying side of the intermediate transfer belt 20, and a cleaner housing 42 in which the scraper 41 is contained. The scraper 41 is fixed at one end by being clamped in a block 43, which is attached to a holder 44 that rocks on a shaft 44*a*. Between a recess 44*b* provided at a lower end of the holder 44 and a bulging portion 42*a* provided at the bottom of the cleaner housing 42, a spring 45 is provided to bias the scraper 41 toward the intermediate transfer belt 20. On the downstream side of the scraper 41 in the moving direction of the intermediate transfer belt 20, a film seal 46 is provided to suppress flying of removed foreign substances to the outside.

The holder 44 may be biased or unbiased in a direction opposite the biasing direction of the spring 45 by an unillustrated cam connected to a cleaner driving motor 27*a*. This allows the scraper 41 to move into contact with and away from the intermediate transfer belt 20. In the exemplary embodiment, when a color image of plural colors is formed, the secondary transfer roller 31 and the belt cleaner 27 are separated from the intermediate transfer belt 20 until a toner image of the second last color passes over the secondary transfer roller 31 and the belt cleaner 27.

Figure 2:
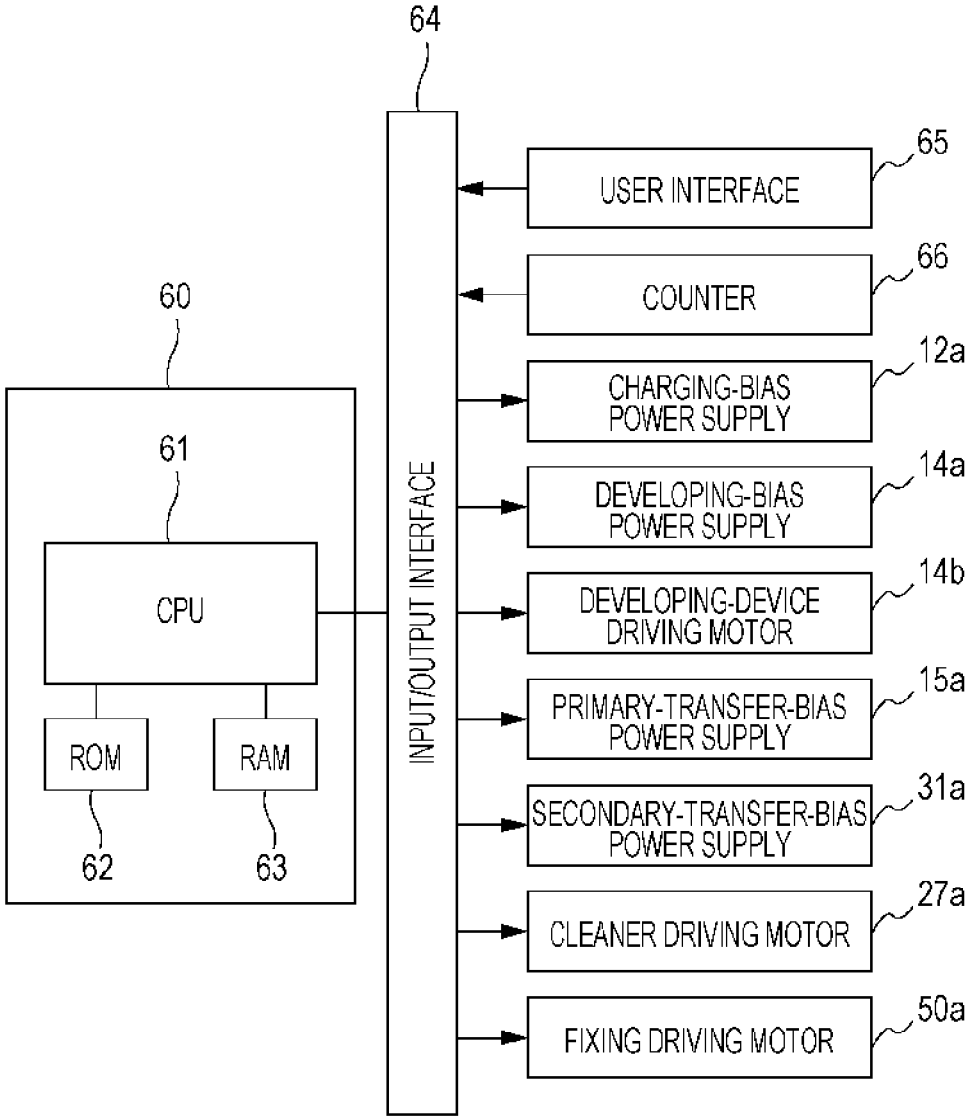
FIG. 2 is a block diagram illustrating a schematic configuration of a controller.

FIG. 2 is a block diagram illustrating a schematic configuration of the controller 60.

The controller 60 includes a CPU 61 that performs arithmetic processing when controlling various motors and so on, a ROM 62 that stores programs to be executed by the CPU 61 and various data, and a RAM 63 used as a working memory for the CPU 61. The CPU 61 performs processing while exchanging data with the RAM 63 according to the programs stored in the ROM 62. The controller 60 also receives, via an input/output interface 64, information about the paper output from a user interface 65 and information about the measured time from a counter 66. Further, the controller 60 controls, via the input/output interface 64, the charging-bias power supply 12*a*, the developing-bias power supply 14*a*, the developing-device driving motor 14*b*, the primary-transfer-bias power supply 15*a*, the secondary-transfer-bias power supply 31*a*, the cleaner driving motor 27*a*, and a fixing driving motor 50*a*.

Next, the fixing device 50 will be described in detail.

Figure 3:
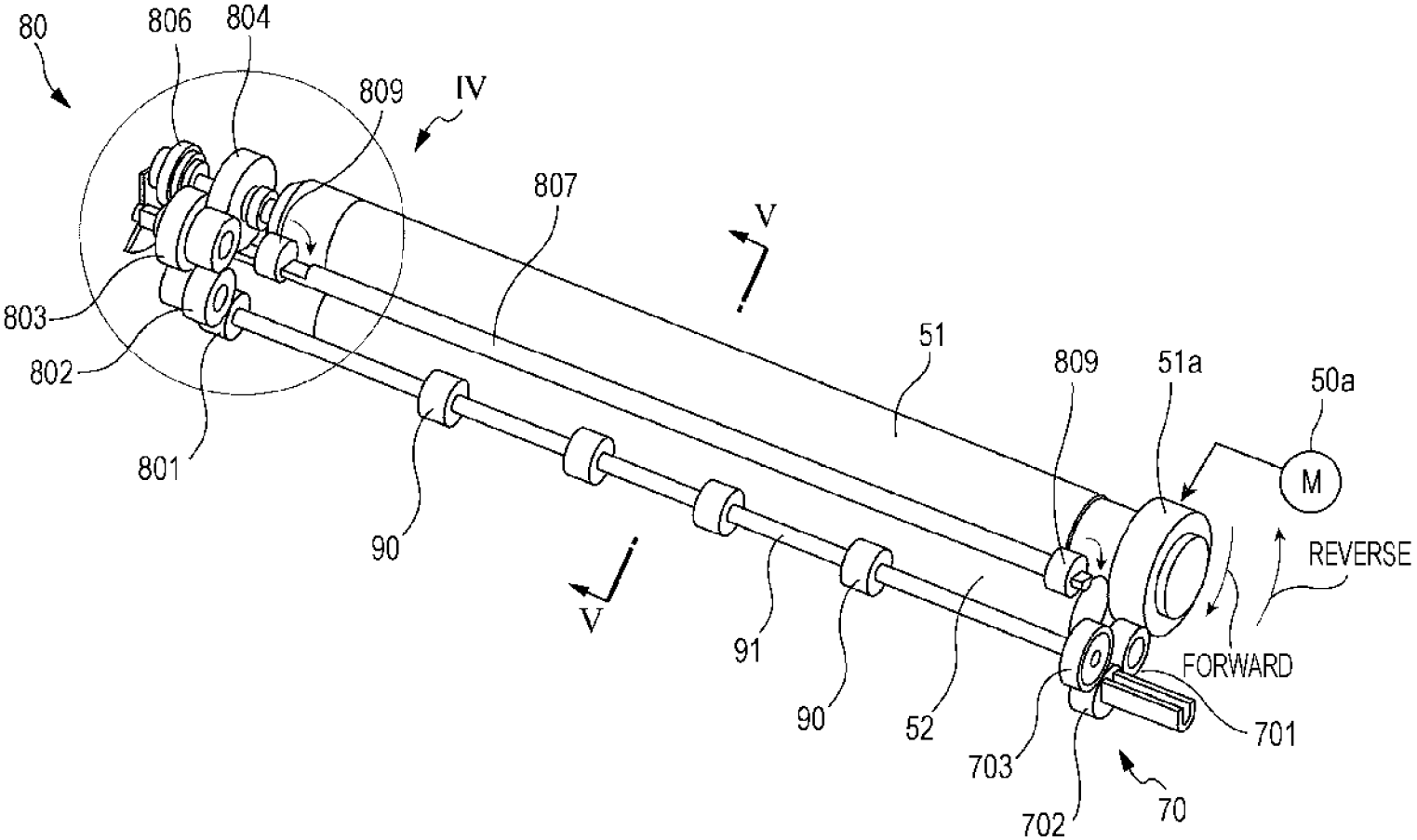
FIG. 3 is a perspective view illustrating a schematic structure of a fixing device.
Figure 4:
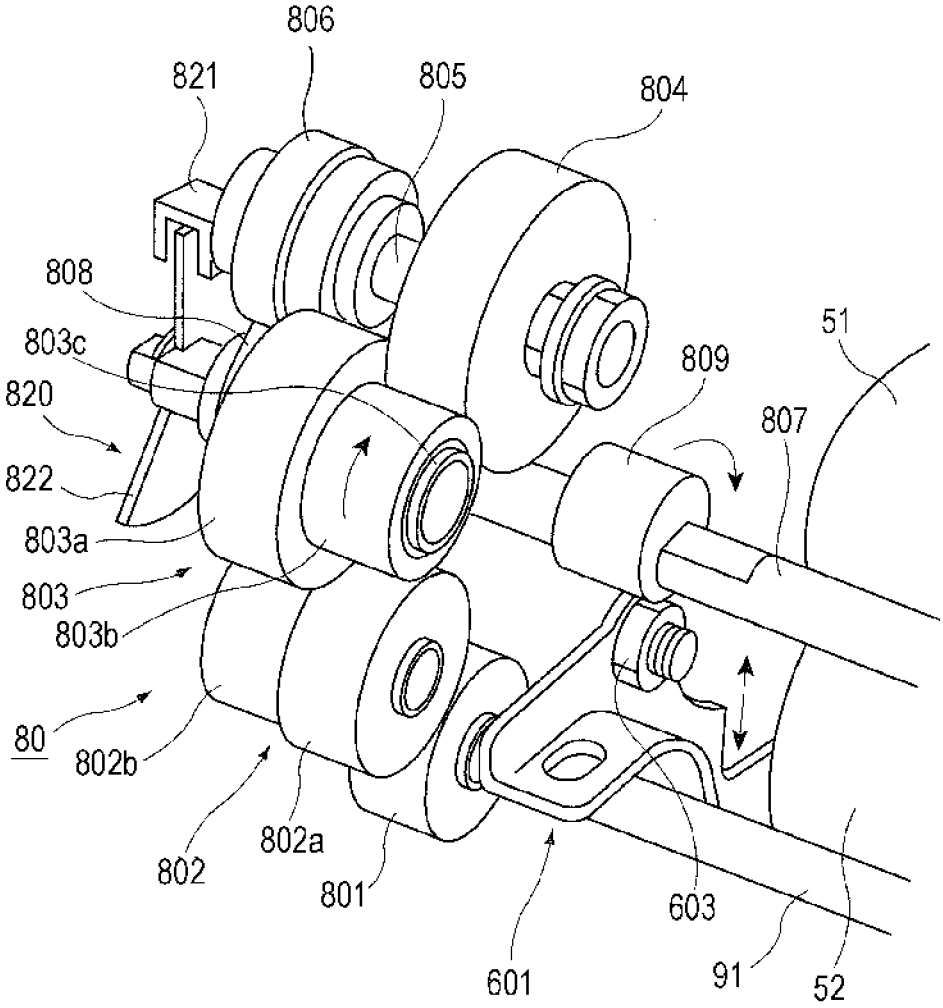
FIG. 4 is an enlarged view of a section IV in FIG. 3.
Figure 5:
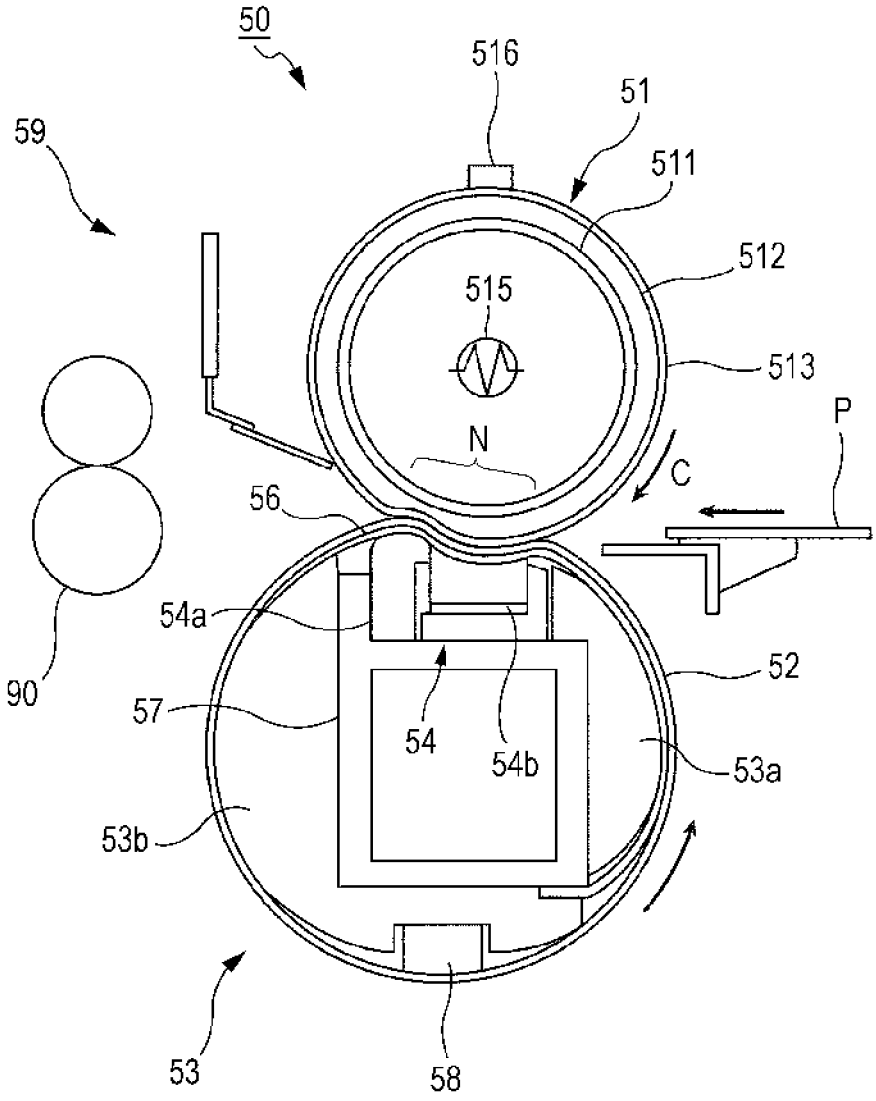
FIG. 5 is a cross-sectional view of the fixing device, taken along line V-V of FIG. 3.
Figure 6:
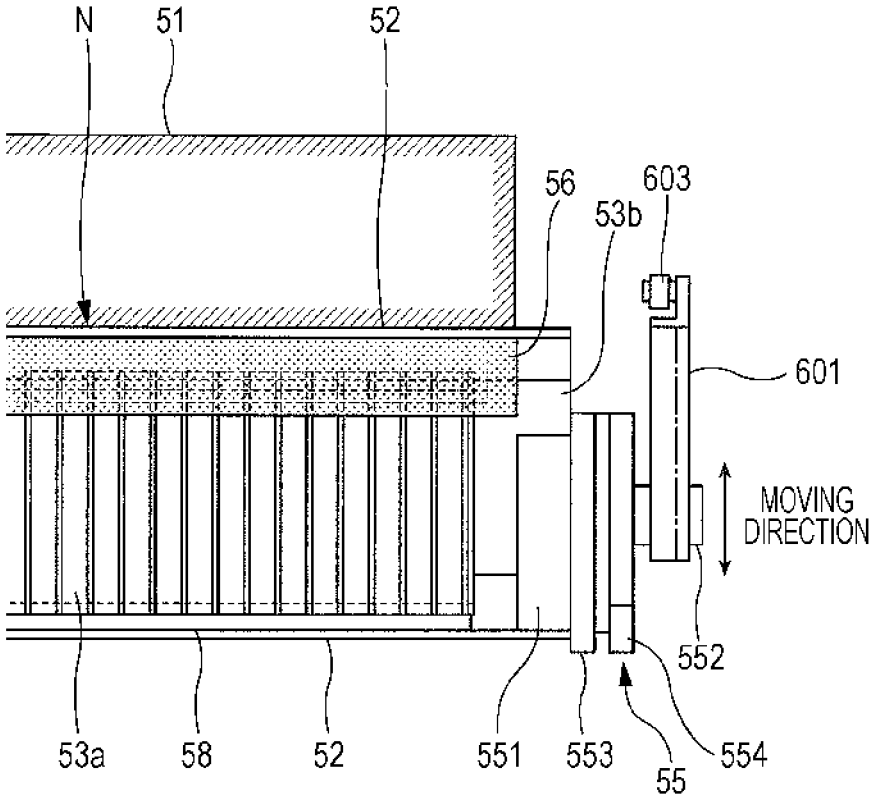
FIG. 6 illustrates a structure of one end of the fixing device in a rotation axis direction of a heating roller.
Figure 7:
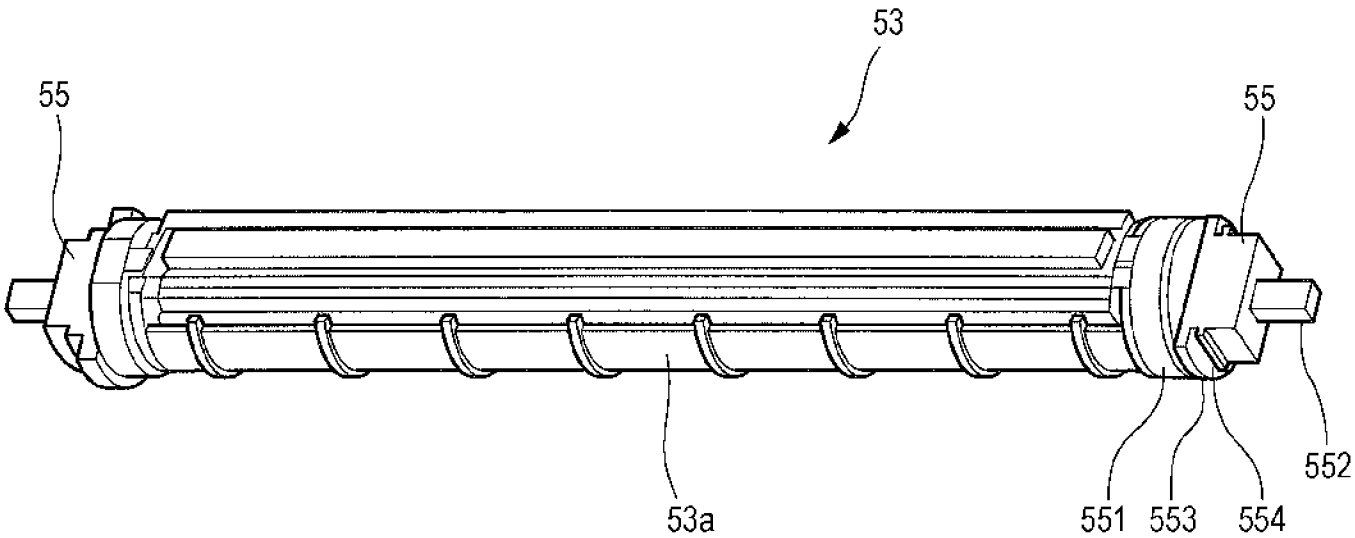
FIG. 7 is a perspective view of a press contact member.
Figure 8:
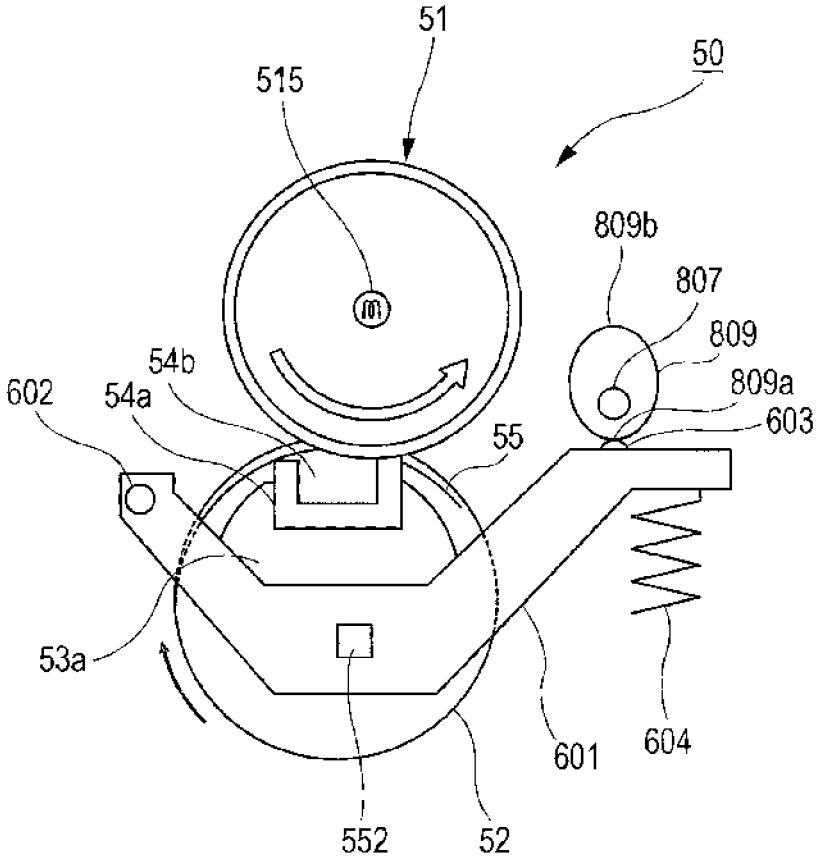
FIG. 8 illustrates a mechanism that adjusts the press contact force produced between the heating roller and an endless belt in the fixing device.

FIG. 3 is a perspective view illustrating a schematic structure of the fixing device 50. FIG. 4 is an enlarged view of a section IV in FIG. 3. FIG. 5 is a cross-sectional view of the fixing device 50, taken along line V-V of FIG. 3. FIG. 6 illustrates a structure of one end of the fixing device 50 in the rotation axis direction of a below-described heating roller 51. FIG. 7 is a perspective view of a below-described press contact member 53. FIG. 8 illustrates a mechanism that adjusts the press contact force produced between the heating roller 51 and an endless belt 52 in the fixing device 50. FIGS. 3 and 5 also illustrate exit rollers 90 provided downstream of the fixing device 50.

The fixing device 50 of the exemplary embodiment includes a heating roller 51 that heats paper P, an endless belt 52 that pressurizes the heating roller 51, a belt support mechanism that supports the endless belt 52 rotatably, a lubricant application member 58 that supplies oil onto an inner surface of the endless belt 52, and a separation assist member 59 that assists in separation of the paper P from the heating roller 51. The fixing device 50 functions as an example of a heating and pressurizing device for heating and pressurizing the paper. The heating roller 51 and the endless belt 52 function as an example of a pair of members in contact with each other. At least one of the heating roller 51 and the endless belt 52 is to be heated.

First, the heating roller 51 will be described. The heating roller 51 is a member that rotates on a shaft extending in a direction orthogonal to the plane of FIG. 1 (a direction extending from one of the front side and the back side to the other (a direction intersecting the paper transport direction)). The heating roller 51 includes a thin cylindrical base 511, a heat-resistant elastic layer 512 provided around the base 511, and a release layer 513 provided on a surface of the heat-resistant elastic layer 512. The heating roller 51 is rotatably supported on a body frame of the color image forming apparatus 100 by bearing members, such as ball bearings, provided at both ends thereof in the rotation axis direction.

The base 511 is a thin cylindrical member. Further, the base 511 is formed of a material having high thermal conductivity, which is elastically deformed by contact of the heating roller 51 and the endless belt 52 and restores because of its own rigidity in a state in which the heating roller 51 and the endless belt 52 are out of contact. Examples of materials having these characteristics are iron, nickel, nickel steel, stainless used steel (SUS), a nickel-cobalt alloy, copper, gold, and a nickel-iron alloy. Since the base 511 has these characteristics, the heating roller 51 is elastically deformed by contact with the endless belt 52, thereby increasing the area of a nip N between the heating roller 51 and the endless belt 52 (FIG. 5) serving as a contact area provided in the paper transport direction, and applying pressure to the paper at the nip N by its elasticity. In a state out of contact with the endless belt 52, the heating roller 51 restores to a cylindrical shape by its own rigidity.

The heat-resistant elastic layer 512 is formed of an elastic material having high heat resistance. While any elastic material having high heat resistance may be used, especially, an elastic material, such as rubber or elastomer, having a rubber hardness of about 25° to 40° (JIS-A) is preferably used. Specifically, silicone rubber or fluororubber may be used as an example.

The release layer 513 is formed of a heat-resistant resin. Any heat-resistant resin may be used, and, for example, silicone resin or fluorine resin may be used. From the viewpoints of releasability from the toner and wear resistance of the release layer 513, fluorine resin is preferably used. As the fluorine resin, PFA, polytetrafluoroethylene (PTFE), or FEP (tetrafluoroethylene-hexafluoropropylene copolymer) may be used. The thickness of the release layer 513 is preferably 5 to 30 μm.

The fixing device 50 further includes a halogen heater 515 provided in the heating roller 51 and functioning as a heat source, and a temperature sensor 516 for detecting the surface temperature of the heating roller 51. On the basis of the temperature detected by the temperature sensor 516, the above-described controller 60 controls power-on of the halogen heater 515 so that the surface temperature of the heating roller 51 is kept at a predetermined fixing temperature (e.g., 170° C.)

Next, the endless belt 52 will be described. The endless belt 52 is originally shaped like a cylinder having a diameter of 30 mm, and includes a base layer and a release layer (not illustrated) covering a heating roller 51 side surface or both surfaces of the base layer. The base layer is formed of polymer, such as polyimide, polyamide, or polyimideamide, or metal such as SUS, nickel, or copper, and preferably has a thickness of 30 to 200 μm. The release layer covering the surface or surfaces of the base layer is formed of fluorine resin such as PFA, PTFE, or FEP, and preferably has a thickness of 5 to 100 μm.

The surface roughness Ra (arithmetic mean roughness) of an inner peripheral surface of the endless belt 52 is set to be 0.4 μm or less so as to reduce sliding resistance to a pressure pad 54 that will be described below. Further, the surface roughness Ra of an outer peripheral surface of the endless belt 52 is set to be 1.2 to 2.0 μm so as to easily receive driving force from the heating roller 51.

Next, a structure of the belt support mechanism will be described.

The fixing device 50 includes a press contact member 53 for pressing the endless belt 52 against the surface of the heating roller 51, edge guides 55 for supporting the endless belt 52 rotatably (FIG. 6), and a low-friction sheet 56 for reducing the sliding resistance between the inner peripheral surface of the endless belt 52 and the press contact member 53 (FIG. 5).

As illustrated in FIG. 5, the press contact member 53 includes a pressure pad 54 for pressing the endless belt 52 against the heating roller 51, belt housings 53*a* and 53*b* formed of synthetic resin, and a metallic holder 57 having a rectangular cross section and fitted in the belt housings 53*a* and 53*b*.

On the inner side of the endless belt 52, the pressure pad 54 is pressed against the heating roller 51 with the endless belt 52 being disposed therebetween, and forms a nip N between the heating roller 51 and the endless belt 52. The pressure pad 54 includes a nip head member 54*a* for pressing the endless belt 52 against the heating roller 51, and a pad member 54*b* attached to the nip head member 54*a*. The pad member 54*b* is formed of an elastic material such as silicone rubber or fluorine rubber, or a leaf spring. A heating roller 51 side surface of the pad member 54*b* is concave almost along the outer peripheral surface of the heating roller 51.

The holder 57 is supported with both ends thereof in the rotation axis direction being fixed to inner side faces of below-described flange portions 553 in the edge guides 55. To the back side of the holder 57, the lubricant application member 58 is attached by bonding or by other methods. The lubricant application member 58 extends in the rotation axis direction of the heating roller 51, and applies lubricant onto the inner peripheral surface of the endless belt 52. The lubricant application member 58 is formed of heat-resistant felt, which is impregnated with, for example, about 3 g of lubricant having a viscosity of 300 cs such as amino-modified silicone oil. The lubricant application member 58 is located in contact with the inner peripheral surface of the endless belt 52, and supplies an appropriate amount of lubricant onto the inner peripheral surface of the endless belt 52 by using osmotic pressure from the heat-resistant felt.

As illustrated in FIG. 7, the edge guides 55 are provided at either end of the holder 57 (FIG. 5) in the rotation axis direction. Each edge guide 55 includes a belt running guide 551 shaped like a cylinder having a cutout corresponding to the nip and its adjacency, that is, having a C-shaped cross section, a mounting portion 552 for mounting the edge guide 55 to a below-described arm member 601 (FIG. 8), and two flange portions 553 and 554 provided between the belt running guide 551 and the mounting portion 552. The belt running guide 551 overlaps with an end of the holder 57 in the rotation axis direction.

The inner peripheral surface of the endless belt 52 at both sides in the rotation axis direction, except the nip N and its adjacency, is supported on outer peripheral surfaces of both belt running guides 551, and the endless belt 52 rotates along the outer peripheral surfaces of the belt running guides 551. Therefore, the belt running guides 551 are formed of a material having a low static friction coefficient that allows smooth rotation of the endless belt 52, and are also formed of a material having a low thermal conductivity that rarely removes heat from the endless belt 52. Further, the flange portions 553 are located at both ends of the holder 57 in the rotation axis direction such that the distance between the inner side faces of the flange portion 553 substantially coincides with the width of the endless belt 52, whereby the movement of the endless belt 52 in the rotation axis direction (belt walk) is restricted. In this way, the movement of the endless belt 52 in the rotating direction and the rotation axis direction is restricted by the edge guides 55.

The low-friction sheet 56 is provided on a surface of the pad member 54*b* in contact with the endless belt 52. Further, to reduce the sliding resistance (friction resistance) between the inner peripheral surface of the endless belt 52 and the pressure pad 54, the low-friction sheet 56 is formed of a material that has low friction coefficient and high resistance to wear and heat. An endless belt 52 side surface of the low-friction sheet 56 has fine irregularities such that the lubricant applied on the inner peripheral surface of the endless belt 52 may enter a sliding portion between the low-friction sheet 56 and the endless belt 52. These irregularities are formed with a roughness Ra (arithmetic mean roughness) of 5 to 30 μm. This is based on the facts that, if the roughness Ra of the irregularities is smaller than 5 μm, it is difficult for a sufficient amount of lubricant to enter the sliding portion on the endless belt 52, and that, in contrast, if the roughness Ra is larger than 30 μm, tracks of the irregularities appear as uneven gloss when fixing is conducted on coated paper. In addition, the low-friction sheet 56 is not permeable (low-permeable) to the lubricant so that the lubricant will not permeate in and leak out from a back surface of the low-friction sheet 56. Specifically, for example, the low-friction sheet 56 may be formed by a sheet in which a porous resin fiber fabric formed of a fluoride resin serves as a base layer and a pressure pad 54 side face of the base layer is wrapped with a PET resin sheet, a sinter-formed PTFE resin sheet, or a glass fiber sheet impregnated with Teflon (registered trademark). The low-friction sheet 56 may be provided separately from the nip head member 54*a* and the pad member 54*b*, or may be provided integrally therewith.

The fixing device 50 further includes arm members 601 that support the mounting portions 552 of the edge guides 55. Each arm member 601 is supported to turn on a pivot 602 provided at one end thereof in the paper transport direction, and has, at the other end in the paper transport direction, a disc-shaped cam follower 603 in contact with an eccentric cam 809 that will be described below. Further, the other end of the arm member 601 in the paper transport direction is biased by a spring 604 so as to press the endless belt 52 against the heating roller 51. The spring 604 expands and contracts in a direction substantially parallel to a line connecting the rotation center of the heating roller 51 and the rotation center of the endless belt 52. Accordingly, the spring 604 functions as an example of a biasing member that biases the endless belt 52 as an example of one of the members against the heating roller 51 as an example of the other member.

Next, a rotary driving mechanism that rotates the fixing device 50 will be described.

As described above, the fixing device 50 is rotated by the fixing driving motor 50*a* illustrated in FIG. 1.

As illustrated in FIG. 3, the fixing device 50 includes a drive gear 51*a* attached to one end of the heating roller 51 in the rotation axis direction. To the drive gear 51*a*, rotating force is transmitted from the fixing driving motor 50*a*. Thus, the rotating force from the fixing driving motor 50*a* is transmitted to the drive gear 51*a*, whereby the heating roller 51 is rotated at a predetermined rotation speed.

Further, as illustrated in FIG. 3, the fixing device 50 includes a driving-force transmission unit 70 having plural gears and coupled to the drive gear 51*a*, and a cam mechanism 80 provided at the other end of the heating roller 51 in the rotation axis direction. The rotating force is transmitted from the drive gear 51*a* to the driving-force transmission unit 70, and is further transmitted to the cam mechanism 80 via a shaft 91 having exit rollers 90. The shaft 91 extends parallel to the rotation shaft of the heating roller 51 on the exit side of the nip N.

The driving-force transmission unit 70 includes a first transmission gear 701 meshed with the drive gear 51*a*, a second transmission gear 702 meshed with the first transmission gear 701, and a third transmission gear 703 meshed with the second transmission gear 702. The third transmission gear 703 is fixed at one end of the shaft 91 in the rotation axis direction.

As illustrated in FIGS. 3 and 4, the cam mechanism 80 includes a fourth transmission gear 801 attached to the other end of the shaft 91 in the rotation axis direction, a first reduction gear 802 meshed with the fourth transmission gear 801, a second reduction gear 803 meshed with the first reduction gear 802, and a fifth transmission gear 804 meshed with the second reduction gear 803.

The fourth transmission gear 801 incorporates a one-way clutch (not illustrated) that does not transmit rotation force when the heating roller 51 and the output rollers 90 on the shaft 91 rotate in the paper transport direction and transmits driving force when the heating roller 51 and the exit rollers 90 rotate in the direction opposite the paper transport direction. Here, the rotating direction of the fixing driving motor 50*a* for rotating the heating roller 51 and the exit rollers 90 in the paper transport direction is sometimes referred to as a "forward direction", and the rotating direction of the fixing driving motor 50*a* for rotating the heating roller 51 and the exit rollers 90 in the direction opposite the paper transport direction is sometimes referred to as a "reverse direction". Further, the rotation of the fixing driving motor 50*a* in the forward direction and the rotation of the fixing driving motor 50*a* in the opposite direction are sometimes referred to as "forward rotation" and "reverse rotation", respectively.

The first reduction gear 802 includes an intermediate gear 802*a* having a relatively large diameter, and an intermediate gear 802*b* coaxially fixed to the intermediate gear 802*a* and having a relatively small diameter. The intermediate gear 802*a* having the large diameter is meshed with the fourth transmission gear 801. The second reduction gear 803 includes an intermediate gear 803*a* having a relatively large diameter, and an intermediate gear 803*b* coaxially fixed to the intermediate gear 803*a* and having a relatively small diameter. The intermediate gear 803*a* having the large diameter is meshed with the intermediate gear 802*b* having the small diameter in the first reduction gear 802. The intermediate gear 803*b* having the small diameter is meshed with the fifth transmission gear 804. As illustrated in FIG. 4, the fifth transmission gear 804 is fixed to one end of a short shaft 805 in the rotation axis direction.

A one-way clutch 803*c* is mounted in the second reduction gear 803, and the second reduction gear 803 transmits the rotating force in the direction of the arrow to the fifth transmission gear 804 via the one-way clutch 803*c*. In contrast, the rotation in the direction opposite the arrow is not transmitted by locking the second reduction gear 803 on a fixed shaft. The fixed shaft of the second reduction gear 803 is fixed to a frame.

The cam mechanism 80 further includes a sixth transmission gear 806, and a seventh transmission gear 808 meshed with the sixth transmission gear 806 and attached to a shaft 807 extending near the exit of the nip N and parallel to the rotation shaft of the heating roller 51. The sixth transmission gear 806 is attached to the other end of the shaft 805 in the rotation axis direction, and the seventh transmission gear 808 is attached to the other end of the shaft 807 in the rotation axis direction.

Next, a description will be given of a press-contact-force change mechanism serving as a change unit that changes the contact pressure formed between the heating roller 51 and the endless belt 52. The press-contact-force change mechanism changes the distance between the heating roller 51 and the endless belt 52 serving as the pair of members, thereby changing the contact pressure therebetween.

As illustrated in FIG. 3, the fixing device 50 includes two eccentric cams 809 serving as examples of rotating members provided at either end of the heating roller 51 in the rotation axis direction. The eccentric cams 809 have the same shape, and outer peripheral surfaces thereof are substantially elliptic. Moreover, the shaft 807 is fixed at eccentric ends of the eccentric cams 809 (see FIG. 8). As illustrated in FIG. 8, these eccentric cams 809 are members where the rotary torque necessary for pushing down the arm members 601 against the biasing force of the springs 604 acts.

As illustrated in FIGS. 4 and 8, the fixing device 50 further includes disc-shaped cam followers 603 that are rotatably provided at the tips of the arm members 601. The cam followers 603 are in contact with the eccentric cams 809 in the cam mechanism 80.

As illustrated in FIG. 8, each arm member 601 is biased upward by a spring 604 attached to the other end thereof in the paper transport direction, and presses the endless belt 52 against the heating roller 51. When the eccentric cam 809 rotates, the other end of the arm member 601 in the paper transport direction is pushed down by the eccentric cam 809 with the cam follower 603 being disposed therebetween. This reduces the press contact force formed between the endless belt 52 and the heating roller 51.

The fixing device 50 further includes a detection device 820 that detects the rotational position of the eccentric cam 809. The detection device 820 includes an optical sensor 821 serving as an example of a detection member attached to the frame, and a semicircular shield plate 822 serving as an example of a synchronous rotation member attached to the other end of the shaft 807 in the rotation axis direction. The optical sensor 821 is a known photointerrupter sensor, and includes two projecting portions provided on a sensor body, and a light emitting element (not illustrated) and a light receiving element (not illustrated) provided in the projecting portions. The optical sensor 821 reads the passage and existence of the shield plate 822 at a position, where the light emitting element and the light receiving element oppose each other, by detecting whether or not the light receiving element receives light emitted from the light emitting element. The shield plate 822 rotates with the rotation of the shaft 807. When an end of the shield plate 822 passes through the optical sensor 821, a pulse signal is transmitted to the controller 60.

In the fixing device 50 having the above-described structure, the forward rotating force of the fixing driving motor 50*a* is transmitted to the shaft 91 and the exit rollers 90 via the drive gear 51*a* and the driving-force transmission unit 70, but is not transmitted downstream of the shaft 91 because the one-way clutch (not illustrated) is incorporated in the fourth transmission gear 801.

Therefore, when a fixing operation is performed to heat and pressurize the paper, the heating roller 51 and the exit rollers 90 are rotated, whereas the eccentric cam 809 provided downstream of the fifth transmission gear 804 remains stopped.

When the fixing driving motor 50*a* serving as the driving member is rotated in the reverse direction before the fixing operation, the rotating force of the fixing driving motor 50*a* is transmitted to the shaft 91 via the drive gear 51*a* and the driving-force transmission unit 70, so that the one-way clutch incorporated in the fourth transmission gear 801 is connected to the shaft 91, and the second reduction gear 803 of the cam mechanism 80 rotates in the direction of the arrow in FIG. 4. In this case, since the one-way clutch 803*c* incorporated in the second reduction gear 803 is rotatably provided on the fixed shaft, the rotating force is transmitted to the fifth transmission gear 804, and the shaft 807 provided with the eccentric cam 809 is rotated via the fifth transmission gear 804, the sixth transmission gear 806, and the seventh transmission gear 808. Then, when the eccentric cam 809 is stopped in a state illustrated in FIG. 8, the cam follower 603 of the arm member 601 comes into contact with an outer peripheral portion of the eccentric cam 809 at the shortest distance from the rotation axis of the shaft 807 (hereinafter referred to as a "lowermost point 809*a*"), and the press contact force generated between the heating roller 51 and the endless belt 52 by the spring 604 becomes the largest.

When the rotation of the fixing driving motor 50*a* is stopped at a position between the lowermost point 809*a* and an outer peripheral portion of the eccentric cam 809 at the longest distance from the rotation axis of the shaft 807 (hereinafter referred to as an uppermost point 809*b*), for example, a position where the midpoint between the lowermost point 809*a* and the uppermost point 809*b* comes into contact with the cam follower 603, an upward biasing force acts on the eccentric cam 809 via the cam follower 603 at the tip of the arm member 601 because of the resilient force of the spring 604. Then, a rotating force in the counterclockwise direction in FIG. 4 acts on the eccentric cam 809, and is transmitted to the second reduction gear 803 as a rotating force in the direction opposite the driving direction of the second reduction gear 803 via the seventh transmission gear 808, the sixth transmission gear 806, and the fifth transmission gear 804.

However, as illustrated in FIG. 4, the one-way clutch 803*c* is incorporated in the intermediate gear 803*b* of the second reduction gear 803, and the opposite rotating force acting on the second reduction gear 803 acts in a direction such that the one-way clutch 803*c* locks the second reduction gear 803 to the fixed shaft. For this reason, even when the rotating force acting on the second reduction gear 803 is transmitted to the one-way clutch 803*c*, the second reduction gear 803 is fixed in the reverse rotating direction, and the reverse rotation of the eccentric cam 809 is prevented.

For this reason, the eccentric cam 809 maintains its state stopped at the rotational position provided when the fixing driving motor 50*a* is stopped.

In such a mechanism, when the fixing driving motor 50*a* is stopped at a desired timing, the arm member 601 is stopped via the eccentric cam 809 at a desired rotational position. This allows the press contact state of the endless belt 52 against the heating roller 51 to be controlled in a stepless manner.

In the fixing device 50 of the exemplary embodiment, in order to increase productivity during fixing, the contact pressure produced between the heating roller 51 and the endless belt 52 is set to be relatively high, and the rigidity of the press contact member 53 for pressing the endless belt 52 against the heating roller 51 is set to be relatively high. For this reason, if the contact pressure between the heating roller 51 and the endless belt 52 is set for thick paper to be equivalent to that for thin paper, the press contact force may become too large at both ends of the paper in the rotation axis direction of the heating roller 51. As a result, for example, when a full-color toner image is fixed over the entire surface of thick paper having a large basis weight, uneven gloss may occur only at both ends of the paper in the rotation axis direction of the heating roller 51. That is, the gloss may become higher over the areas having a width of about 20 mm from the ends than other portions (e.g., the center portion).

In view of this circumstance, in the fixing device 50 of the exemplary embodiment, the contact pressure produced between the heating roller 51 and the endless belt 52 is changed according to the type of paper to be subjected to fixing (paper type), that is, depending on whether the paper is uncoated paper or coated paper and according to the basis weight of the paper. That is, as the basis weight of the paper increases, the amount by which the arm member 601 is pushed down by the eccentric cam 809 is increased to decrease the contact pressure. When the basis weight is not changed, the contact pressure between the heating roller 51 and the endless belt 52 for the coated paper is made lower than or equal to that for the uncoated paper so that the press contact force for the coated paper is smaller than or equal to that for the uncoated paper.

The contact pressure is changed according to the paper type by changing the timing, at which the reverse rotation of the fixing driving motor 50*a* is stopped, according to the paper type.

Figures 9A, 9B, 9C:
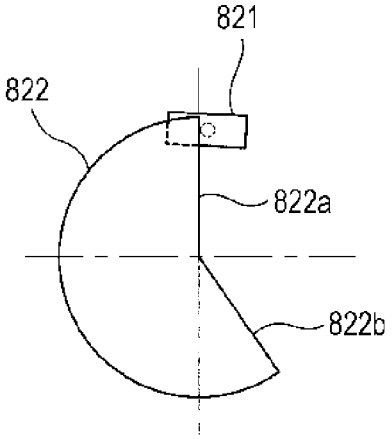
FIGS. 9A to 9C show the relationship among the paper type, the target rotation angle at the stop position of an end of a shield plate for determining the stop position of the endless belt relative to the heating roller, and the reference elapsed time at which a fixing driving motor is stopped.

FIG. 9A is a table showing the relationship among the paper type, the target rotation angle of the stop position of one end face 822*a* of the shield plate 822 for determining the stop position of the endless belt 52 relative to the heating roller 51, and the reference elapsed time for stopping the fixing driving motor 50*a*. The target rotation angle of the stop position of the end face 822*a* of the shield plate 822 is zero-based on the Y-axis provided when the optical sensor 821 is located as in FIG. 9B, as viewed in the rotation axis direction. Further, the reference elapsed time for stopping the fixing driving motor 50*a* refers to an elapsed time that elapses until the fixing driving motor 50*a* is stopped after the optical sensor 821 detects the one end face 822*a* of the shield plate 822 by switching from light shielding to light reception.

As shown in FIG. 9A, the stop position of the endless belt 52 relative to the heating roller 51 is set such that the rotation angle from the zero base increases as the basis weight of the paper increases, and such that the rotation angle from the zero base for the coated paper is larger than or equal to that for the uncoated paper when the basis weight is not changed.

After the controller 60 detects the one end face 822*a* of the shield plate 822 as an example of a first mark by switching from light shielding to light reception and the reference elapsed time predetermined according to the paper type, as illustrated in FIG. 9A, elapses, the fixing driving motor 50*a* is stopped, thereby adjusting the press contact force according to the paper type. In the following description, an operation of the controller 60 for rotating the fixing driving motor 50*a* so as to obtain a contact pressure corresponding to the type of paper to be subjected to fixing will be referred to as "press contact operation", and an operation for rotating the fixing driving motor 50*a* to reduce the increased contact pressure will be referred to as "press-contact release operation".

If the reference elapsed time is uniformly determined according to the product specifications in accordance with the temperature around the components of the press-contact-force change mechanism during image formation, changes with time of the components, and variations in component shapes, even when the fixing driving motor 50*a* is stopped on the basis of this reference elapsed time, the eccentric cam 809 may not stop at the target stop position, and the contact pressure may differs from the target contact pressure. In this case, uneven gloss may appear on the paper, as described above.

In view of this circumstance, the controller 60 of the exemplary embodiment controls the driving of the fixing driving motor 50*a* so that the stop position of the endless belt 52 relative to the heating roller 51 (distance between the heating roller 51 and the endless belt 52) coincides with the target stop position (target distance) as follows. That is, the controller 60 performs control in consideration of the displacement between the target stop position (target distance) and an actual stop position (actual distance) at which the fixing driving motor 50*a* is previously stopped so as to stop the endless belt 52 at the target stop position when the reference elapsed time (target time) elapses.

Since the fixing driving motor 50*a* rotates at the predetermined rotation speed, a total time Tall as the sum of a time (reference elapsed time) Tb1 and a theoretic time (hereinafter referred to as "reference remaining time") Tb2 is constant regardless of the paper type (Tall=Tb1+Tb2). The reference elapsed time Tb1 refers to the time that elapses from when the optical sensor 821 detects the one end face 822*a* of the shield plate 822 by switching from light shielding to light reception to when the fixing driving motor 50*a* is stopped. The theoretic time Tb2 refers to the time that elapses from when the fixing driving motor 50*a* is then rotated again to when the fixing driving motor 50*a* is stopped at the time when the optical sensor 821 detects the other end face 822*b* of the shield plate 822 as an example of a second mark by switching from light reception to light shielding.

FIG. 9C shows the reference remaining time Tb2 corresponding to the paper type.

The reference remaining time Tb2 decreases as the reference elapsed time Tb1 increases.

For this reason, the displacement between the actual stop position in the previous press contact operation and the target stop position may be detected by measuring an actual remaining time Ta2 as an example of an actual elapsed time from when the driving of the fixing driving motor 50*a* for reducing the contact pressure (press contact release operation) starts to when the optical sensor 821 detects switching from light reception to light shielding. That is, the time difference between the reference remaining time Tb2 corresponding to the paper type and the actual remaining time Ta2 corresponds to the displacement of the stop position. From this time, the displacement between the target stop position and the actual stop position in the previous press contact operation may be detected. In other words, it is possible to detect the difference between the target distance and the actual distance between the heating roller 51 and the endless belt 52 in the previous press contact operation. In this way, the controller 60 functions as an example of a detecting unit that detects the difference between the target distance and the actual distance between the heating roller 51 and the endless belt 52 provided in the previous time when the fixing driving motor 50*a* is controlled so that the distance coincides with the target distance.

This means that, when the actual remaining time Ta2 is shorter than the reference remaining time Tb2, the fixing driving motor 50*a* excessively rotates beyond the target stop position although the fixing driving motor 50*a* is stopped when the predetermined reference elapsed time elapses in order to stop the fixing driving motor 50*a* at the target stop position. In contrast, when the actual remaining time Ta2 is longer than the reference remaining time Tb2, the fixing driving motor 50*a* does not reach the target stop position although the fixing driving motor 50*a* is stopped when the predetermined reference elapsed time elapses in order to stop the fixing driving motor 50*a* at the target stop position.

That is, it is considered that, when the actual remaining time Ta2 is shorter than the reference remaining time Tb2, the fixing driving motor 50*a* is stopped at the target stop position by making the elapsed time, which elapses from when the optical sensor 821 detects switching from light shielding to light reception to when the fixing driving motor 50*a* is stopped, shorter than the reference elapsed time by an amount corresponding to the absolute value (=|Ta2−Tb2|) of an error time obtained by subtracting the reference remaining time Tb2 from the actual remaining time Ta2. In contrast, it is considered that, when the actual remaining time Ta2 is longer than the reference remaining time Tb2, the fixing driving motor 50*a* is stopped at the target stop position by making the elapsed time, which elapses from when the optical sensor 821 detects switching from light shielding to light reception to when the fixing driving motor 50*a* is stopped, longer than the reference elapsed time by the amount corresponding to the absolute value (=|Ta2−Tb2|) of the error time obtained by subtracting the reference remaining time Tb2 from the actual remaining time Ta2.

Accordingly, in the exemplary embodiment, the reference elapsed time Tb1 serving as an example of a first reference time, which is predetermined, as shown in FIG. 9A, is corrected on the basis of an error time Tab (=Ta2−Tb2) obtained by subtracting the reference remaining time Tb2 serving as an example of a second reference time from the actual remaining time Ta2 in the previous press contact release operation. More specifically, the time obtained by adding the error time Tab to the reference elapsed time Tb1, which is predetermined, as shown in FIG. 9A, serves as a corrected reference elapsed time Tb1', and the fixing driving motor 50*a* is stopped when the corrected reference elapsed time Tb1' elapses after the optical sensor 821 detects switching from light shielding to light reception.

For example, when the paper is uncoated paper (Tb1=150 (msec), Tb2=555 (msec)) having a basis weight (more than or equal to 80 gsm and less than 150 gsm) and the actual remaining time Ta2 in the previous press contact release operation is 540 msec, the error time Tab (Ta2−Tb2) is −15 msec, and the corrected reference elapsed time Tb1' is 150+(−15)=135 msec. In a current press contact operation, the fixing driving motor 50*a* is stopped when Tb1' (=135 msec) elapses after the optical sensor 821 detects switching from light shielding to light reception.

When the actual remaining time Ta2 in the previous press contact release operation is obtained, the term "previous" preferably refers to an actual remaining time Ta2 in a press contact operation and a press contact release operation performed at a time as close to the current time as possible. For this reason, when the press contact operation and the press contact release operation are requested in succession, the actual remaining time Ta2 in the next previous press contact operation and press contact release operation is measured, and the reference elapsed time Tb1 is corrected by the actual remaining time Ta2. Alternatively, prior to the current press contact operation, a press operation and a press contact release operation may be performed only in order to obtain the actual remaining time Ta2, and the reference elapsed time Tb1 may be corrected by the actual remaining time Ta2.

A procedure of the fixing operation performed by the controller 60 will be described with reference to a flowchart.

Figure 10:
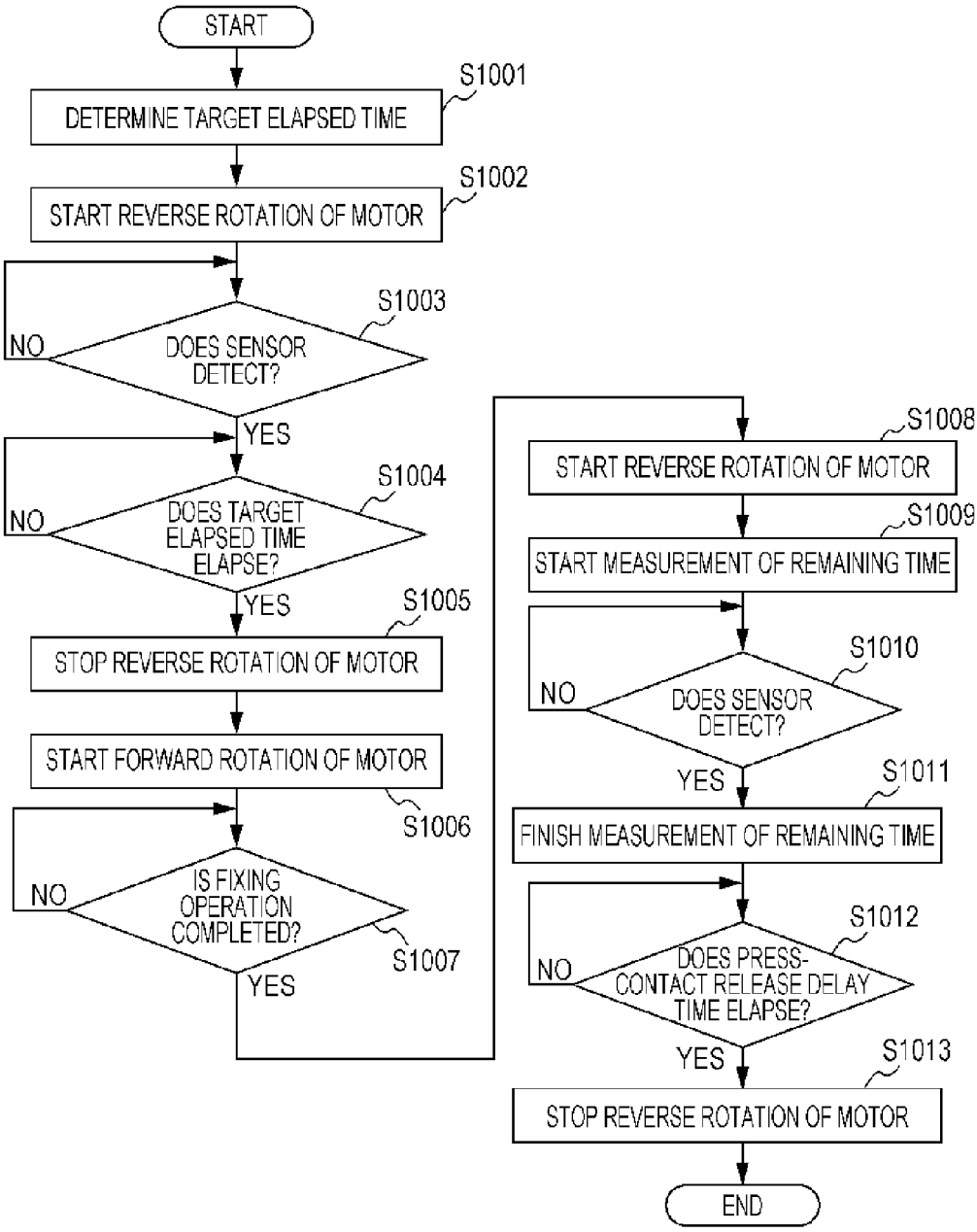
FIG. 10 is a flowchart showing a procedure of a fixing operation performed by the controller.

FIG. 10 is a flowchart showing the procedure of the fixing operation performed by the controller 60. The controller 60 performs this fixing operation when receiving a command to perform the fixing operation. FIGS. 11A to 11E illustrate positions of the shield plate 822 in the fixing operation.

First, the controller 60 determines a target elapsed time at which the fixing driving motor 50*a* is stopped after the optical sensor 821 detects switching from light shielding to light reception (Step (hereinafter simply referred to as "S") 1001). The type of paper to be subjected to fixing, that is, whether the paper is uncoated paper or coated paper, and the basis weight of the paper are determined on the basis of information about the paper input from the user interface 65, and the target elapsed time is determined on the basis of a reference elapsed time Tb1 prestored in the ROM 62 serving as an example of a memory in correspondence to the paper type and a previous error time Tab stored in the RAM 63. As described above, when the error time Tab is not stored, the reference elapsed time Tb1 is determined as the target elapsed time. When the error time Tab is stored, the sum of the reference elapsed time Tb1 and the error time Tab is determined as the target elapsed time.

Figure 11A:
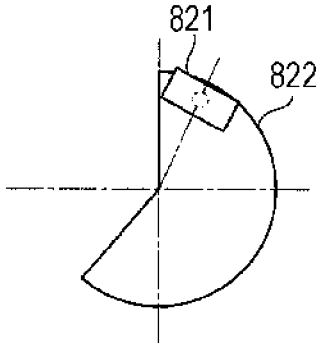
FIGS. 11A to 11E illustrate the position of the shield plate during the fixing operation.
Figure 11B:
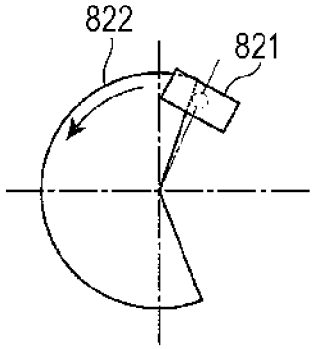

After that, the controller 60 rotates the fixing driving motor 50*a* in the reverse direction so as to perform a press contact operation (S1002), and determines whether or not the optical sensor 821 detects switching from light shielding to light reception (S1003). FIG. 11B illustrates a state in which the optical sensor 821 detects switching from light shielding to light reception.

Figure 11C:
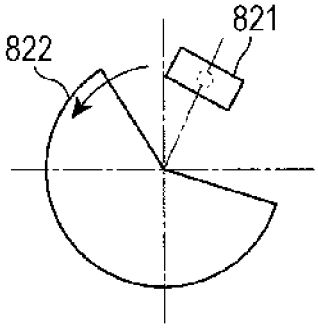

When the optical sensor 821 does not detect switching from light shielding to light reception (No in S1003), the controller 60 stands by until the optical sensor 821 detects. In contrast, when the optical sensor 821 detects switching from light shielding to light reception (Yes in S1003), the controller 60 determines whether or not the target elapsed time determined in S1001 elapses (S1004). FIG. 11C illustrates a state in which the target elapsed time has elapsed after the optical sensor 821 detects switching from light shielding to light reception.

When the target elapsed time determined in S1001 does not elapse (No in S1004), the controller 60 stands by until the target elapsed time elapses. In contrast, when the target elapsed time determined in Step S1001 elapses (Yes in S1004), the reverse rotation of the fixing driving motor 50*a* is stopped (S1005).

Figure 11D:
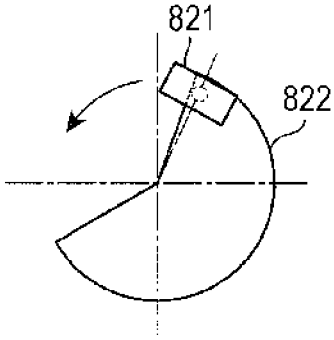
Figure 11E:
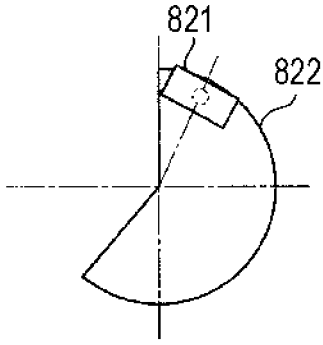

After that, the controller 60 rotates the fixing driving motor 50*a* in the forward direction so as to perform a fixing operation (S1006), and determines whether or not the fixing operation is completed (S1007). When the fixing operation is not completed (No in S1007), the controller 60 stands by until the fixing operation is completed. In contrast, when the fixing operation is completed (Yes in S1007), a press contact release operation is started (S1008). That is, the fixing driving motor 50*a* is rotated in the reverse direction, and measurement of a remaining time Ta2 is started (S1009). After that, it is determined whether or not the optical sensor 821 detects switching from light reception to light shielding (S1010). FIG. 11D illustrates a state in which the optical sensor 821 detects switching from light reception to light shielding.

When the optical sensor 821 does not detect switching from light reception to light shielding (No in S1010), the controller 60 stands by until the optical sensor 821 detects. In contrast, when the optical sensor 821 detects switching from light reception to light shielding (Yes in S1010), measurement of the remaining time Ta2 is finished. Also, an error time Tab is calculated from the measured time and a reference remaining time Tb2 predetermined, as shown in FIG. 9C, and the calculated error time Tab is stored in the RAM 63 (S1011).

After that, it is determined whether or not a predetermined press contact release delay time elapses (S1012). When the press contact release delay time does not elapse (No in S1012), the controller 60 stands by until the press contact release delay time elapses. In contrast, when the press contact release delay time elapses (Yes in S1012), the reverse rotation of the fixing driving motor 50*a* is stopped to stop the press contact release operation (S1013).

When the controller 60 performs this fixing operation, the displacement between the actual stop position in the previous press contact operation and the target stop position is reflected in the current press contact operation. Hence, the endless belt 52 is precisely stopped at the target stop position. This suppresses uneven gloss on the paper due to the fixing operation.

When the press contact operation and the press contact release operation are performed prior to the current fixing operation in order to obtain the actual remaining time Ta2, S1006 and S1007 in the flowchart of FIG. 10 may be omitted. Further, in order to use an error time Tab in an environment closer to the environment where the current fixing operation is performed, the error time Tab stored in the RAM 63 may be erased when a predetermined time (e.g., 10 minutes) elapses.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating and pressurizing device comprising:

a roller configured to rotate about an axis of rotation while generating heat;

a pressurizing member configured to contact a circumferential surface of the roller and to form a nip in order to heat and press and to convey a recording medium therebetween;

a support member that supports the pressurizing member;

a cam member that sets a distance between the axis of rotation and the support member by assuming an angular position;

a motor configured to rotate the roller by executing a forward rotation and to rotate the cam member by executing a reverse rotation;

an optical detector configured to detect a reference angular position of the cam member;

a timing unit configured to control an angular position of the cam member by executing the reverse rotation of the motor for a predetermined period of time;

an input unit for inputting information related to a basis weight of the recording medium or a type of the recording medium; and a controller configured to control the timing unit based on the reference angular position of the cam member detected by the optical detector and the information inputted in the input unit.

2. The heating and pressurizing device of claim 1, wherein the controller sends a signal to stop rotating of the motor when the predetermined period of time has elapsed.

3. The heating and pressurizing device of claim 1, wherein the basis weight of the recording medium corresponds to a thickness of the recording medium.

4. The heating and pressurizing device of claim 1, wherein the type of the recording medium corresponds to a coating of the recording medium.

5. The heating and pressurizing device of claim 1, wherein a contact pressure between the roller and the pressurizing member is changed according to the information.

* * * * *